US008828154B2

(12) United States Patent
Hoshi et al.

(10) Patent No.: US 8,828,154 B2
(45) Date of Patent: Sep. 9, 2014

(54) HOT-ROLLED STEEL SHEET, METHOD FOR MAKING THE SAME, AND WORKED BODY OF HOT-ROLLED STEEL SHEET

(75) Inventors: Toru Hoshi, Tokyo (JP); Saiji Matsuoka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 278 days.

(21) Appl. No.: 11/887,285

(22) PCT Filed: Mar. 29, 2006

(86) PCT No.: PCT/JP2006/307175

§ 371 (c)(1), (2), (4) Date: Sep. 27, 2007

(87) PCT Pub. No.: WO2006/107066

PCT Pub. Date: Oct. 12, 2006

(65) Prior Publication Data

US 2009/0252641 A1 Oct. 8, 2009

(30) Foreign Application Priority Data

Mar. 31, 2005 (JP) ..... 2005-103831
Jan. 26, 2006 (JP) ..... 2006-017634

(51) Int. Cl.

| | |
|---|---|
| ***C22C 38/00*** | (2006.01) |
| ***C21D 8/00*** | (2006.01) |
| ***C22C 38/04*** | (2006.01) |
| ***C22C 38/12*** | (2006.01) |
| ***C22C 38/02*** | (2006.01) |
| ***C22C 38/06*** | (2006.01) |
| *C21D 8/02* | (2006.01) |

(52) U.S. Cl.

CPC ..... *C22C 38/02* (2013.01); *C22C 38/12* (2013.01); *C21D 2211/008* (2013.01); *C22C 38/04* (2013.01); *C21D 2211/005* (2013.01); *C22C 38/06* (2013.01); *C21D 8/0226* (2013.01); *C21D 8/0247* (2013.01)

USPC ..... 148/337; 148/320; 148/654; 420/120; 420/124; 420/127

(58) Field of Classification Search

USPC ..... 420/117, 118, 120, 123, 127, 128, 124; 148/337, 654, 320

See application file for complete search history.

(56) References Cited

U.S. PATENT DOCUMENTS 6,709,535 B2 * 3/2004 Utsumi et al. ..... 148/334

FOREIGN PATENT DOCUMENTS

| | | | |
|---|---|---|---|
| EP | 1398390 | A1 * | 3/2004 |
| JP | 62-74051 | A | 4/1987 |
| JP | 4-74824 | A | 3/1992 |
| JP | 10-147838 | A | 6/1998 |
| JP | 10-310824 | A | 11/1998 |
| JP | 11-199975 | A | 7/1999 |
| JP | 2002-47536 | A | 2/2002 |
| JP | 2003-221623 | A | 8/2003 |
| JP | 2004-162085 | A | 6/2004 |

OTHER PUBLICATIONS

Nuss et al., English machine translation of EP 1398390 A1, Mar. 2004.*

* cited by examiner

*Primary Examiner* — Roy King
*Assistant Examiner* — Caitlin Kiechle
(74) *Attorney, Agent, or Firm* — RatnerPrestia

(57) ABSTRACT

A steel sheet contains, in terms of percent by mass, C: 0.01 to 0.2%, Si: 2.0% or less, and Mn: 3.0% or less and has a martensite phase as dominant phase and ferrite with a grain size of 20 μm or less as a second phase. The ferrite is contained in area ratio of 1% to 30% and the amount of solute carbon being 0.01 percent by mass of more. The steel sheet can provide a hot-rolled steel sheet suitable for automobile steel sheet, i.e., has excellent press workability and excellent strain aging property whereby the tensile strength significantly increases by heat treatment at about the same temperature as typical baking process after the press-working. Moreover, hardening of the ferrite phase improves the fatigue strength after the strain aging.

8 Claims, 2 Drawing Sheets

HOT-ROLLED STEEL SHEET, METHOD FOR MAKING THE SAME, AND WORKED BODY OF HOT-ROLLED STEEL SHEET

RELATED APPLICATION

This is a §371 of International Application No. PCT/JP2006/307175, with an international filing date of Mar. 29, 2006 (WO 2006/107066 A1, published Oct. 12, 2006), which is based on Japanese Patent Application Nos. 2005-103831, filed Mar. 31, 2005, and 2006-017634, filed Jan. 26, 2006.

TECHNICAL FIELD

This disclosure relates to a hot-rolled steel sheet and to a method for making the same. The hot-rolled steel sheet is suitable as hot-rolled steel sheets for automotives that require press workability such as bendability, stretch-flangeability, and the like. The hot-rolled steel sheet is particularly suited to applications that require excellent strain aging property or, in addition, excellent fatigue property (fatigue strength).

"Strain aging property" refers to the property in which the tensile strength increases by heat treatment after press forming. "Excellent strain aging property" refers to the strain aging property in which ΔTS is 100 MPa or more, where ΔTS is defined as an increase in tensile strength by strain aging, i.e., (tensile strength of the steel sheet subjected to strain aging)-(tensile strength of the steel sheet not subjected to strain aging).

As the strain aging, pre-straining at a plastic strain of 2% or more (1.5% or more when the accuracy of the strain control is high) is performed and then heat-treatment (aging) is conducted at a temperature in the range of 150° C. to 200° C. for a retention time of 30 seconds or more. Unless otherwise noted, ΔTS is the average value obtained under conditions of aging: 150° C., 20 minutes and aging: 200° C., 20 minutes wherein pre-strain is 3%.

BACKGROUND

With the recent trends of emission gas regulations from the standpoint of preservation of global environment, reduction of body weight of automobiles has become a critical issue. Thus, a study is being made on reduction of body weight by increasing the strength of the steel sheets used for automobile body and decreasing the steel sheet thickness thereby.

The structural components of automobiles to which such high-strength steel sheets are applied are usually made by press-working and hole-expanding. Thus, the steel sheets, which are the raw material, must have high hole expandability in addition to press workability.

In addition to the issue of environmental preservation, recently, safety of the automobile body is considered as important for protection of passengers in the event of collision. Thus, improvements of impact resistance, which is a measure for safety in the event of collision, are required. For the improvement of the impact resistance, at least the strength of the components of an entire car is preferably as high as possible.

However, in general, increasing the strength of steel sheets decreases the elongation and thus degrades press workability. Moreover, since yield strength is also increased by the increase in strength, there is also a problem of poor shape fixability after pressing. Furthermore, with regard to a high-strength steel sheet mainly composed of a martensitic structure, increasing the elongation to enhance the press workability decreases the hole expandability, and, conversely, increasing the hole expandability decreases the elongation.

As such, it is difficult for a steel sheet to achieve both press workability and hole expandability by simply increasing the strength of the steel sheet.

Japanese Unexamined Patent Application Publication No. 2003-221623 discloses an example of an attempt to achieve both press workability and impact resistance, i.e., a cold-rolled steel sheet containing C: 0.02 to 0.15% (on a mass basis, hereinafter the same), Mn: 2.0 to 4.0%, Nb: 0.01 to 0.1%, and the balance being Fe and inevitable impurities, in which the structure is a dual-phase structure (ferrite and second phase) having an average grain size of 5 μm or less. However, according to this technique, not only hot-rolling but also cold-rolling and annealing must be conducted under adequate control to yield a desired structure. Thus, the production cost is high, and load of facilities notably increases if thick steel sheets (4 mm or more) are to be produced. Furthermore, this technique cannot fundamentally overcome the problem of shape fixability.

Also, since continuous annealing and continuous hot dip zincing are concerned, the steel ultimately undergoes heat treatment at 400° C. or more. As a result, it is considered that sufficient strain aging (described in detail below) cannot be obtained due to precipitation of stable iron carbide (cementite) and a decrease in amount of solute carbon.

As described above, a hot-rolled steel sheet that has low strength, high press workability, and high hole expandability during forming of automobile components and exhibits high strength and high impact resistance when the sheet is worked into a finished product has been strongly demanded.

As a related art handling such a demand, a bake-hardenable steel sheet has been developed under an aim of obtaining a steel sheet that has high strength and further, high press workability. This steel sheet features an increased yield stress by subjecting it to a bake-finish process (including retaining at a constant temperature of 100° C. to 200° C.) after press working.

This steel sheet has a structure in which ferrite is the matrix and the amount of the solute carbon in a solid-solution state is controlled in an adequate range. This steel sheet is soft during press working and dislocations are introduced into the ferrite during forming. During the bake finishing conducted after the press working, the solute carbon remaining therein is hooked to dislocations to pin the dislocations, thereby increasing the yield stress. In the past, a phenomenon of an increase in yield strength has been traditionally referred to as strain aging.

However, although the yield stress can be increased by the bake-hardenable steel sheet, the tensile strength cannot be increased. The effect is also not sufficient with regard to impact resistance.

Japanese Unexamined Patent Application Publication No. 62-74051 discloses a hot-rolled high-tensile strength steel sheet having excellent strain aging property and aging resistance (resistance to deterioration of material properties due to room-temperature aging, aging resistance at RT), the sheet containing C: 0.08 to 0.2%, Mn: 1.5 to 3.5%, and the balance being Fe and inevitable impurities, the structure of the sheet being a multi-phase structure containing 5% or less of ferrite, and bainite or partially containing martensite.

Although the hot-rolled steel sheet described in Japanese Unexamined Patent Application Publication No. 62-74051 has high strain aging property, the tensile strength still cannot be increased. The effect on improvement of impact resistance is insufficient.

Japanese Unexamined Patent Application Publication No. 4-74824 discloses a hot-rolled high-tensile strength steel sheet having excellent strain aging property and aging resistance, the sheet containing C: 0.02 to 0.13%, Si: 2% or less, Mn: 0.6 to 2.5%, and the balance being Fe and inevitable impurities and having a dual-phase microstructure mainly composed of ferrite and martensite.

Despite the strain aging property of the hot-rolled steel sheet described in Japanese Unexamined Patent Application Publication No. 4-74824, the tensile strength is still not improved, and the effect on the improvement of the impact resistance is insufficient. There is also a drawback of poor hole expandability.

Japanese Unexamined Patent Application Publication No. 10-310824 proposes a method for making a galvannealed steel sheet that uses a hot-rolled steel sheet or a cold-rolled steel sheet as the black plate, in which the strength is expected to increase by heat treatment after working. This is the technology in which a steel containing C: 0.01 to 0.08%, adequate amounts of Si, Mn, P, S, Al, and N, and 0.05 to 3.0% of at least one of Cr, W, and Mo in total is hot-rolled (and additionally cold-rolled and optionally temper-rolled and annealed), and subjected to galvanizing and then to thermal alloying. The resulting steel sheet has a microstructure of a ferritic single phase, ferrite+pearlite, or ferrite+bainite.

Japanese Unexamined Patent Application Publication No. 10-310824 teaches that the tensile strength can be increased by heating the resulting steel sheet in the temperature range of 200° C. to 450° C. after working. However, high ductility and low yield strength are not achieved, and there is a problem of decreased press workability.

Components of automobile bodies are under repeated stresses and are required to exhibit excellent fatigue property in addition to the above-described properties. In particular, these requirements are more acute when the sheet thickness is reduced by increasing the strength.

As an technique aiming to improve the fatigue property, Japanese Unexamined Patent Application Publication No. 11-199975 proposes a hot-rolled steel sheet for processing working having excellent fatigue property, the sheet containing C: 0.03 to 0.20%, adequate amounts of Si, Mn, P, S, and Al, Cu: 0.2 to 2.0%, and B: 0.0002 to 0.002%, the microstructure being a dual-phase structure including a ferritic dominant phase and a martensitic second phase, in which the state of existence of Cu in the ferrite phase is a solid solution state and/or a precipitation state of 2 nm or less.

However, the steel sheet described in Japanese Unexamined Patent Application Publication No. 11-199975 does not show how all the press workability, hole expandability and the impact resistance are achieved at the same time. Moreover, since addition of Cu is necessary, there is also a problem of difficulty of scrapping and recycling.

As described above, there has been strongly demanded a hot-rolled steel sheet that exhibits a low TS and high press-workability and hole-expandability during forming of the automobile components but high TS and impact resistance once the sheet is worked into a finished product, and a hot-rolled steel sheet having excellent fatigue in addition to these properties. However, the technology that enables stable industrial production of steel sheets that satisfy all of these properties has not been available.

It could therefore be advantageous to provide a hot-rolled steel sheet suitable for automobile steel sheets, the hot-rolled steel sheet having excellent press-workability and hole-expandability and excellent strain aging property by which the tensile strength notably increases after press forming by heat treatment at about the same temperature as that of the known baking process. It could also be advantageous to provide a hot-rolled steel sheet having significantly improved fatigue property in addition to the strain aging property, and to provide a method that enables stable manufacturing of these hot-rolled steel sheets.

SUMMARY

We found that the tensile strength can be remarkably increased by aging or further the fatigue strength can be remarkably enhanced by forming a microstructure. The microstructure includes a small amount of ferrite phase with controlled grain size, among which a martensite phase exists, and in which solute carbon remains. We provide:

(1) A hot-rolled steel sheet having excellent strain aging property, containing, in terms of percent by mass, C: 0.01 to 0.2%, Si: 2.0% or less, Mn: 3.0% or less, P: 0.1% or less, S: 0.02% or less, Al: 0.1% or less, N: 0.02% or less, the balance being Fe and inevitable impurities, in which a martensite phase is a dominant phase, a ferrite phase as a second phase is contained in the range of 1% or more and 30% or less in terms of area ratio, the average grain size of the ferrite phase being 20 μm or less, and an amount of solute carbon is 0.01 percent by mass or more.

(2) A hot-rolled steel sheet having excellent strain hardening property, including, in terms of percent by mass, C: 0.01 to 0.2%, Si: 2.0% or less, Mn: 3.0% or less, P: 0.1% or less, S: 0.02% or less, Al: 0.1% or less, N: 0.02% or less, the balance being Fe and inevitable impurities, in which an untempered martensite phase is a dominant phase, and a ferrite phase as a second phase is contained in the range of 1% or more and 30% or less in terms of area ratio, the average grain size of the ferrite phase being 20 μm or less.

(3) The hot-rolled steel sheet having excellent strain aging property according to (1) or (2) above, further containing at least one of Nb, Ti, V, and Mo in a total amount of 0.2% or less in terms of percent by mass.

(4) The hot-rolled steel sheet having excellent strain aging property according to any one of (1) to (3) above, wherein Mn: 2.0% or less and the average grain size of the ferrite phase is 5 μm or less.

(5) A hot-rolled steel sheet having excellent fatigue property and strain aging property, containing, in terms of percent by mass, C: 0.01 to 0.2%, Si: 2.0% or less, Mn: 3.0% or less, P: 0.1% or less, S: 0.02% or less, Al: 0.1% or less, N: 0.02% or less, the balance being Fe and inevitable impurities, in which a martensite phase is a dominant phase, a ferrite phase as a second phase is contained in the range of 1% or more and 30% or less in terms of area ratio, the average grain size of the ferrite phase being 15 μm or less, an amount of solute carbon is 0.01 percent by mass or more, and a hardness $Hv(M_{SA})$ of the martensite phase and a hardness $Hv(\alpha_{SA})$ of the ferrite phase each after strain aging involving pre-strain: 1.5% and aging: 200° C., 20 minutes satisfy formula (I) below:

$$Hv(\alpha_{SA})/Hv(M_{SA}) \geq 0.6 \quad \text{Formula (1).}$$

(6) A hot-rolled steel sheet having excellent fatigue property and strain aging property, containing, in terms of percent by mass, C: 0.01 to 0.2%, Si: 2.0% or less, Mn: 3.0% or less, P: 0.1% or less, S: 0.02% or less, Al: 0.1% or less, N: 0.02% or less, the balance being Fe and inevitable impurities, in which an untempered martensite phase is a dominant phase, a ferrite phase as a second phase is contained in the range of 1% or more and 30% or less in terms of area ratio, the average grain size of the ferrite phase being 15 μm or less, and a hardness $Hv(M_{SA})$ of the martensite phase and a hardness $Hv(\alpha_{SA})$ of the ferrite phase each after strain aging involving pre-strain: 1.5% and aging: 200° C., 20 minutes satisfy formula (1) below:

$$Hv(\alpha_{SA})/Hv(M_{SA}) \geq 0.6 \quad \text{Formula (1).}$$

(7) The hot-rolled steel sheet having excellent fatigue property and strain aging property according to (5) or (6) above, further containing at least one of Nb, Ti, V, and Mo in a total amount of 0.2% or less in terms of percent by mass.

(8) A method for making a hot-rolled steel sheet having excellent strain aging property, including the steps of: hot-rolling a steel slab such that a finishing temperature of finish rolling is the $Ar_3$ point or higher, the steel slab containing, in terms of percent by mass, C: 0.01 to 0.2%, Si: 2.0% or less, Mn: 3.0% or less, P: 0.1% or less, S: 0.02% or less, Al: 0.1% or less, N: 0.02% or less, and the balance being Fe and inevitable impurities; after the finish rolling, cooling the resulting material to a martensite transformation temperature (Ms point) or less at a cooling rate of 20° C./sec or more and coiling the material at a temperature of 300° C. or less; and not subjecting the resulting material to tempering at a temperature of 350° C. or more.

(9) The method for making a hot-rolled steel sheet having excellent strain aging property according to (8) above, in which the steel slab further contains at least one of Nb, Ti, V, and Mo in a total amount of 0.2% or less in terms of percent by mass.

(10) The method for making a hot-rolled steel sheet having excellent strain aging property according to (8) or (9) above, in which Mn: 2.0% or less.

(11) A worked body of hot-rolled steel sheet having high strength and excellent fatigue property, produced by subjecting a hot-rolled steel sheet to press working and strain aging, the product containing: C: 0.01 to 0.2%, Si: 2.0% or less Mn: 3.0% or less, P: 0.1% or less S: 0.02% or less, Al: 0.1% or less, N: 0.02% or less, and the balance being Fe and inevitable impurities; in which a martensite phase is a dominant phase, a ferrite phase as a second phase is contained in the range of 1% or more and 30% or less in terms of area ratio, the average grain size of the ferrite phase being 15 μm or less, and a hardness Hv(M) of the martensite phase and a hardness Hv(α) of the ferrite phase satisfy formula (1)'below:

$$Hv(\alpha)/Hv(M) \geq 0.6 \quad \text{Formula (1)'.}$$

In (11) above, the product preferably contains at least one of Nb, Ti, V, and Mo in a total amount of 0.2% or less in terms of percent by mass.

DETAILED DESCRIPTION

We conducted extensive research on influence of the steel sheet microstructure and alloy elements on strain aging property. The experiments and the results thereof are described below. Note that the measurement and analysis were conducted through the procedures described in Examples below.

Experimental Results 1

To determine the tensile strength brought about by strain aging, the difference ΔTS between the tensile strength TS' of a steel sheet subjected to strain aging (equivalent to the tensile strength after heat treatment) and the tensile strength TS of a steel sheet not subjected to strain aging (equivalent to the tensile strength before pre-straining) was used for evaluation.

Figure 1:
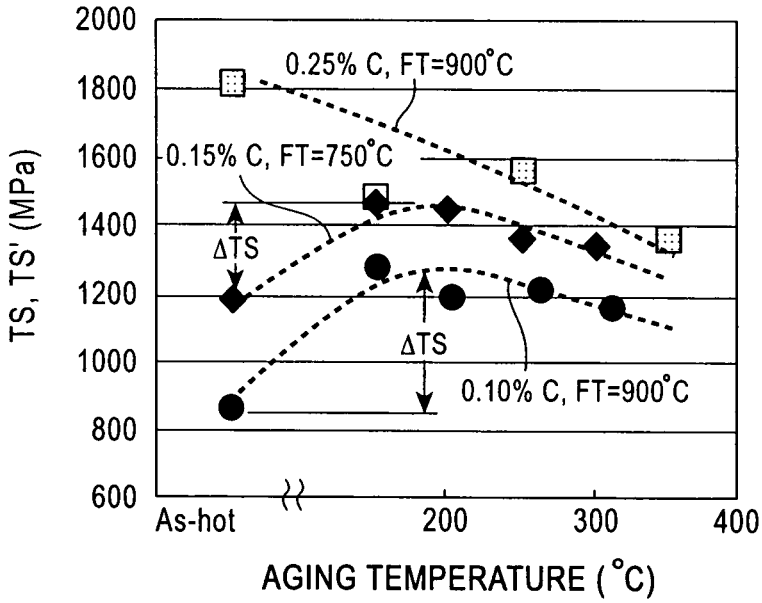
FIG. 1 is a graph showing the relationship between the tensile strength (TS) of each of the hot-rolled steel sheets having different carbon contents and involving various different hot-rolling conditions and the tensile strength (TS') after the steel sheet was subjected to strain aging by changing the heating temperature of aging.

FIG. 1 shows the relationship between the tensile strength (TS) of each of the hot-rolled steel sheets having different carbon contents and involving various different hot-rolling conditions and the tensile strength (TS') after the steel sheet was subjected to strain aging by changing the heating temperature of aging. The pre-strain was 3% in all cases, and the length of time of aging was 20 minutes.

In FIG. 1, the ordinate indicates TS and TS'(MPa), the abscissa indicates the aging temperature (° C.), and the leftmost points indicate cases without strain aging (as-hot). In other words, ΔTS is the difference in TS between the as-hot material and the aged material.

In the case where the finishing temperature FT=900° C. and the carbon content is 0.25 percent by mass (steel sheet A, indicated by open squares), the structure is a martensite single-phase microstructure. In contrast, in the case where FT=900° C. and the carbon content is 0.10 percent by mass (steel sheet B, indicated by circles) and in the case where FT=750° C. and the carbon content is 0.15 percent by mass (steel sheet C, indicated by rhombuses), the structure is a dual-phase microstructure of martensite and ferrite where the ferrite content is about the same (about 5% in terms of area ratio). In the case where FT=750° C. and the carbon content is 0.15 percent by mass (steel sheet C), precipitation treatment is conducted to decrease the amount of solute carbon. The amounts of the solute carbon in the steel sheets A, B, and C not subjected to strain aging were 0.07%, 0.15%, and 0.03% by mass, respectively.

As is apparent from FIG. 1, the strength of the martensite single-phase microstructure decreases after strain aging. In contrast, a dual-phase steel sheet including martensite and ferrite exhibits an increase in tensile strength (ΔTS) of 200 MPa or more by strain aging at 200° C. In the case where no precipitation treatment is conducted and therefore the amount of solute carbon is high, that is, FT=900° C. and the carbon content is 0.10 percent by mass, a further higher strain aging can be achieved with substantially the same amount of ferrite.

As described above, it has been found that high strain aging hardening can be achieved by a structure containing martensite as the dominant phase and ferrite as the second phase.

Experimental Results 2

Figure 2:
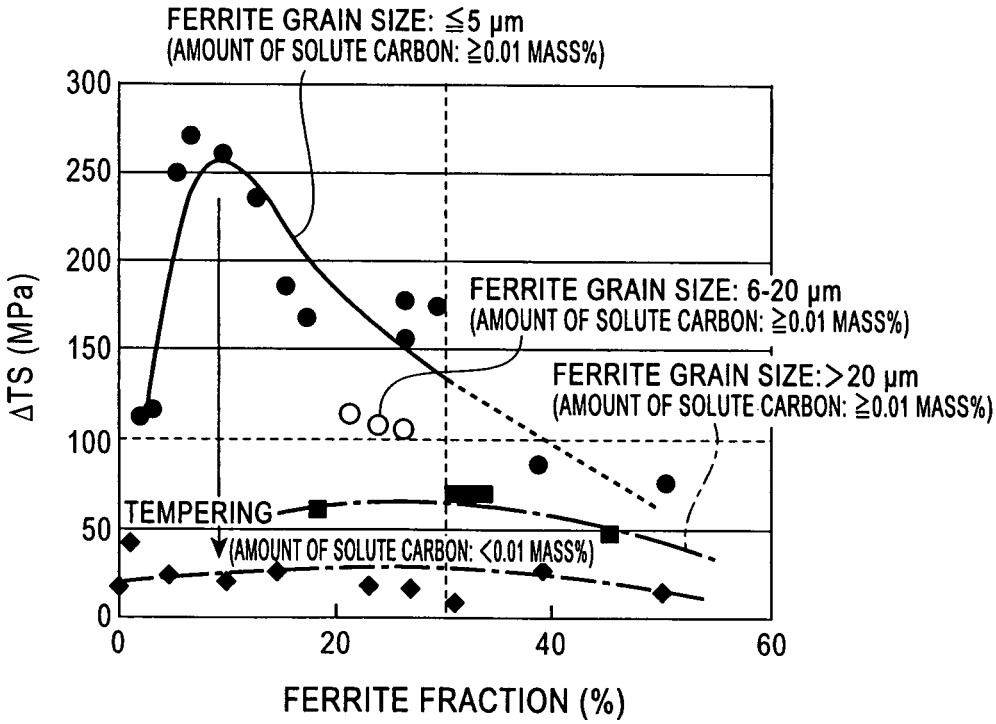
FIG. 2 shows the results of detailed investigations on the effect of the ferrite fraction, ferritic grain size, and amount of solute carbon on ΔTS.

We found that to achieve such a high strain aging, the amount of solute carbon in the steel sheet must be adjusted to 0.01 percent by mass or more and the ferrite fraction (ratio) and the ferrite grain size must be regulated in the martensite-ferrite microstructure. FIG. 2 shows the results of detailed investigations on the effect of the ferrite fraction, ferritic grain size, and amount of solute carbon on ΔTS. In FIG. 2, the abscissa indicates the ferrite fraction (%) and the ordinate indicates ΔTS (MPa). The ferrite fraction means the ratio of the area of the ferrite phase in the microstructure, and the ferritic grain size means the average grain size of the ferritic grains. The conditions of the strain aging are: pre-strain: 3%, aging temperature: 150° C. and 200° C. (results are averaged), and aging time: 20 minutes.

In the case where the ferritic grain size is 20 μm or less and the amount of solute carbon is 0.01 percent by mass or more (Group A indicated by solid circles and Group B indicated by open circles), ΔTS of 100 MPa or more can be obtained at a ferrite fraction in the range of 1% to 30%. In the case where the ferritic grain size is 5 μm or less and the amount of solute carbon is 0.01 percent by mass or more (Group A), ΔTS at the same ferrite fraction is higher than that when the ferritic grain size is 6 to 20 μm (Group B). In particular, in Group A, when the ferrite fraction is in the range of 3 to 25%, ΔTS as high as 150 MPa or more can be achieved.

In contrast, even when the amount of solute carbon is 0.01 percent by mass or more, ΔTS is only about 50 to 70 MPa if the ferritic grain size exceeds 20 μm (Group C indicated by squares) irrespective the ferrite fraction. Moreover, when a steel sheet having a ferritic grain size of 20 μm or less (for example, 5 μm or less in the example shown in FIG. 2) and containing 0.01 percent by mass or more of solute carbon is heat-treated at 350° C. for 20 minutes to form cementite and decrease the amount of solute carbon to less than 0.01 percent by mass (Group D indicated by rhombuses), ΔTS notably drops to 50 MPa or less.

In other words, in order to achieve high strain aging, it is necessary to have martensite as a dominant phase, adequately adjust the area ratio and grain size of the ferrite as the second phase, and maintain the amount of solute carbon to 0.01 percent by mass or more.

Mechanism of Strain Aging

The mechanism of strain aging that causes notable ΔTS is not completely clear. However, we believe that it is attributable to interaction between the carbon atoms and the dislocations as with existing bake-hardenable (BH) steel sheets. The mechanism is believed to be as follows.

That is, since the structure of the steel sheet includes martensite as the dominant phase and soft ferrite is surrounded by the martensite, the harder martensite does not undergo deformation during deformation by applying pre-strain and deformation focuses on the softer ferrite. As a result, a high strain is introduced to the ferrite to cause hardening.

Furthermore, since the martensite is tempered by the subsequent thermal aging, supersaturated carbon (C) existing in the martensite becomes diffused through the dislocations and strain in the ferrite and is precipitated. As a result, the dislocations in the ferrite are tightly adhered by the precipitates of carbon (i.e., pinned dislocation) and the tensile strength (TS) further increase thereby. Although the details of the precipitation of carbon contributing to the increased strength are not completely clear, the precipitates are assumed to be quasi-stable iron carbides since they undergo aging in the temperature range of 200° C. or less. Note that when pre-strain is not applied, it is considered that carbon cannot be diffused since the dislocations and strain in the ferrite are little. In such a case, the effect of increasing the strength is not achieved.

Experimental Results 3

We also conducted studies on the microstructure and fatigue property of the steel sheet after strain aging. In the study, to measure changes in steel sheet microstructures caused by strain aging, hardness (Hv) of the steel sheet after strain aging was measured. Moreover, the fatigue property was evaluated by tensile fatigue test. Tensile fatigue test was conducted on a steel sheet subjected to strain aging (pre-strain: 1.5%, aging conditions: 200° C., 20 minutes), and the fatigue strength ratio (FL'/TS), which was the ratio of the fatigue limit under pulsating tension (FL') to the tensile strength (TS) of the steel sheet before strain aging.

Figure 3:
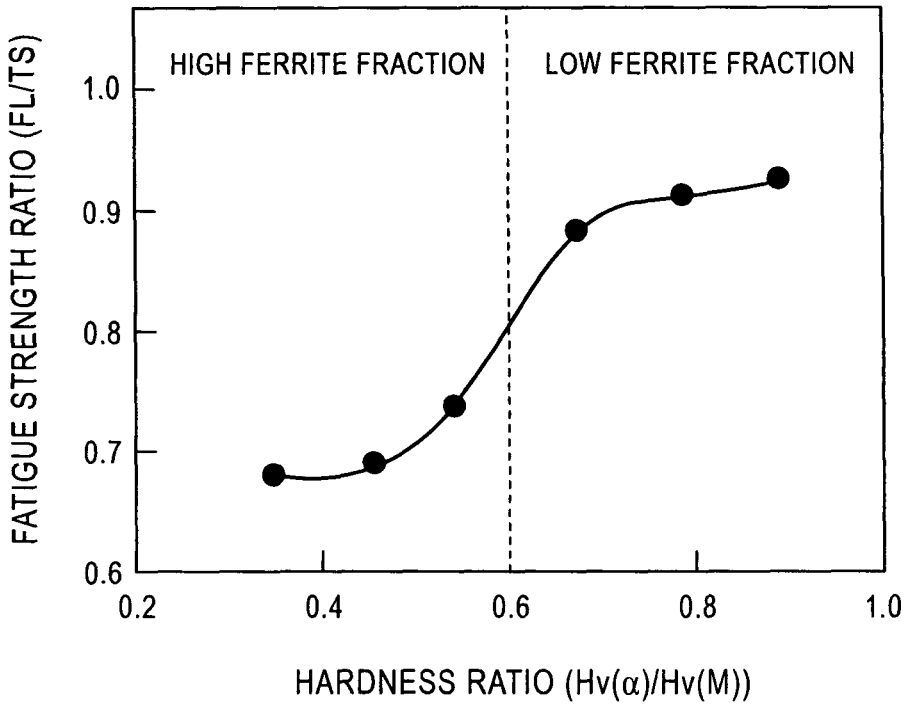
FIG. 3 shows the effect of the hardness ratio Hv(α)/Hv(M) of the hardness Hv(α) of the ferrite to the hardness Hv(M) of the martensite on the fatigue property of the steel sheet after strain aging.

FIG. 3 shows the effect of the hardness ratio Hv(α)/Hv(M) (abscissa) of the hardness Hv(α) of the ferrite to the hardness Hv(M) of the martensite on the fatigue property (fatigue strength ratio: ordinate). The relationship between the hardness ratio of after the strain aging and the microstructure of the steel sheet before the strain aging is described below. In this study, the hardness ratio was changed mainly by changing the ferrite fraction.

As shown in this graph, a steel having a high ferrite fraction exhibits a hardness ratio Hv(α)/Hv(M) of the ferrite to the martensite after the strain aging of less than 0.6, and the fatigue strength ratio (FL'/TS) observed at this time is as low as about 0.7. In contrast, it has also been found that when the dual phase steel having a low ferrite fraction is subjected to thermal strain aging at 200° C., the hardness ratio Hv(α)/Hv(M) of the ferrite to the martensite becomes as high as over 0.6, and the fatigue strength ratio (FL'/TS) dramatically improves to 0.8 or more.

Steel Type of the Invention Steel Sheet

We provide steel sheets known as dual phase structure high-tensile strength hot-rolled steel sheets, in particular, hot-rolled steel sheets having a tensile strength TS of 450 MPa or more. Preferably, the tensile strength is 600 MPa or more. According to the structure, the anticipated maximum tensile strength is about 1800 MPa.

The steel sheet has strain-aging property, whose tensile strength notably increases by heat treatment at a relatively low temperature after press-forming, thereby achieving the change in strength ΔTS of 100 MPa or more. According to a more preferable steel sheet, ΔTS is 150 MPa or more, and according to a most preferable steel sheet, ΔTS is 200 MPa or more. The maximum ΔTS is anticipated to be about 400 MPa.

As a preferable steel sheet, a steel sheet having excellent fatigue property, i.e., a fatigue strength ratio of 0.8 or more, is obtained.

Steel Sheet Microstructure

The microstructure of the steel sheet is first described.

The microstructure of the steel sheet has a dual phase microstructure including a dominant martensite phase not subjected to tempering and a second ferrite phase having an area ratio of 1% or more and 30% or less and a grain size of 20 μm or less.

The reason for defining the grain size of the ferrite to 20 μm or less is that many dislocations serving as precipitation sites can be introduced into the ferrite by pre-straining. The range is preferably 15 μm or less and more preferably 10 μm or less. In particular, at a grain size of 5 μm or less, significant strain aging can be achieved. The lower limit for achieving the effect is about 0.1 μm, and a preferable lower limit from the standpoint of production is 0.5%.

The area ratio of the ferrite is set to 1% or more and 30% or less for the following reason. At a ferrite area ratio less than 1%, tempering of the martensite easily occurs at low temperature and softening easily occurs, as shown by the material with 0.25 percent by mass of C and FT=900° C. in FIG. 1. In contrast, at a ferrite area ratio exceeding 30%, a strong effect of increasing the strength (ΔTS) cannot be obtained even when the amount of solute carbon effective for strain aging is 0.01 percent by mass of more. The lower limit is more preferably 3% and most preferably 12%. The upper limit is more preferably 25% and most preferably 20%.

The steel sheet microstructure may include, in addition to the martensite dominant phase and the ferrite second phase, a retained (residual) austenite, bainite, or pearlite as a third phase occupying the remainder, the fraction (area ratio) of the third phase being less than that of the second phase. However, since the presence of the third phase usually decreases ΔTS, the fraction of the third phase is preferably not more than ½ of the second phase from the standpoint of achieving a further enhanced effect of increasing the strength. Most preferably, the third phase is substantially zero.

The grain sizes of the dominant phase and the third phase other than the ferrite phase are not particularly limited but are preferably about 5 to 50 μm and about 0.1 to 5 μm, respectively, which is achieved by the producing method described later, from the standpoint of mechanical properties. For the martensite phase, the grain size is defined as the former γ grain size. No limit is imposed on the shape of the grains of each phase, but the ferrite phase frequently has a shape relatively closed to an equiaxed grain shape (i.e., not stretched).

To achieve high strain aging, the above-described microstructure must be formed and the amount of solute carbon must be 0.01 percent by mass or more. One approach effective for adjusting the amount of solute carbon to 0.01 percent by mass or more is to adjust the microstructure to contain the ferrite with 20 μm or less at an area ratio of 1% to 30% in the martensite phase by controlling hot-rolling and the cooling history following the hot-rolling (or to adjust the microstructure to the above-described more preferable microstructure) while preventing tempering of the martensite.

More preferably, the amount of solute carbon is adjusted to 0.03 percent by mass of more by controlling the cooling history or the like.

In order to improve the fatigue property in addition to the strain aging property, the grain size of the ferrite phase, which is the second phase, is adjusted to 15 μm or less.

In order to improve the fatigue property, it is effective to decrease the difference between the hardness $Hv(M_{SA})$ of the martensite phase and the hardness $HV(\alpha_{SA})$ of the ferrite phase after strain aging (in order to avoid confusion with non-aged value, the subscript SA (strain-aged) is added to clarify that the value is one after strain aging).

In particular, after the strain aging, the ratio of the hardness $Hv(\alpha_{SA})$ of the ferrite phase to the hardness of the hardness $Hv(M_{SA})$ of the martensite phase must satisfy the following equation:

$$Hv(\alpha_{SA})/Hv(M_{SA}) \geq 0.6 \quad \text{(Equation (1))}.$$

That is, if $Hv(\alpha_{SA})/Hv(M_{SA})<0.6$, then the difference in hardness (after strain aging) between the martensite and the ferrite is large. Thus, cracks will occur from the interface between the martensite and the ferrite, and these cracks propagate in the interface between the martensite and the ferrite with a large difference in hardness during the repeat fatigue test, thereby resulting in poor fatigue property. In contrast, if $Hv(\alpha_{SA})/Hv(M_{SA}) \geq 0.6$, then occurrence of cracks is prevented during the fatigue test, and propagation of the cracks is suppressed, thereby leading to improved fatigue property.

In order to increase the ratio of $Hv(\alpha_{SA})$ to $Hv(M_{SA})$, it is effective to control the microstructure as described above, i.e., control the fraction of the ferrite phase and the third phase to lower values, to make ferrite grains fine grains, and to maintain the amount of solute carbon. In other words, when strain is applied to a steel sheet having a microstructure including a martensite dominant phase and a ferrite second phase, a larger degree of work hardening occurs in the soft ferrite compared to the martensite. The ferrite further hardens by low-temperature heat treatment at, for example, 200° C. or less. The hardening becomes significant as the ferritic grain size becomes smaller. In particular, when the grain size is 15 μm or less, $Hv(\alpha_{SA})/Hv(M_{SA}) \geq 0.6$ can be easily satisfied and the fatigue property increases remarkably.

Note that Equation (1) above is not always satisfied by adjusting the ferritic grain size to 15 μm or less. The hardening of the ferrite phase may not be sufficient to satisfy Equation (1) if pre-strain is not concentrated on the ferrite phase for the reasons such as softening of the martensite phase by precipitation of carbides or hardening of the ferrite phase due to excess solute carbons. Furthermore, when the fraction of the ferrite phase or the third phase is relatively high, hardening of the ferrite phase may not be sufficient to satisfy Equation (1) above. In such cases, the microstructure should be corrected to improve hardening of the ferrite phase.

Steel Sheet Composition

The reasons for limiting the composition of the hot-rolled steel sheet will now be described. In the description below, % means percent by mass.

C: 0.01 to 0.2%

Carbon (C) increases the strength of the steel sheet and promotes formation of a dual-phase microstructure containing martensite and ferrite. At a C content less than 0.01%, the dual-phase microstructure of martensite and ferrite does not easily occur. Further, to achieve a desired high strain aging property, the amount of solute carbon needs to be at least 0.01%. At a carbon content exceeding 0.2%, the fraction of the martensite increases and the fraction of the ferrite excessively decreases, thereby leading to decreased ductility and poor strain aging property. Thus, the C content is set to 0.01 to 0.2%. From the standpoint of improving the spot weldability, the C content is preferably 0.15% or less.

Si: About 2.0% or Less

Silicon (Si) is a strengthening element useful for increasing the strength of the steel sheet without notably decreasing the ductility of the steel sheet and has an effect of promoting formation of ferrite. Addition of 0.005% or more is preferred to promote formation of the ferrite. At a Si content exceeding 2.0%, excessive ferrite will be formed, leading to degradation in press workability, a decrease in effect of increasing the strength, and degradation in surface properties. Thus, the Si content is set to 2.0% or less. The Si content is preferably 0.5% or less if the surface properties are the important.

Mn: 3.0% or Less

Manganese (Mn) has an effect of strengthening the steel and promoting formation of a dual-phase microstructure including martensite and ferrite. Manganese is also effective for preventing hot-work cracking by sulfur (S) and is preferably contained in an amount depending on the S content. Since these effects are notable at a Mn content of 0.5% or more, the Mn content is preferably 0.5% or more. In contrast, at a Mn content exceeding 3.0%, press workability and weldability are degraded, and formation of the ferrite is suppressed. Thus, the Mn content is set to 3.0% or less. From the standpoint of formation of ferrite, the Mn content is preferably 2.0% or less. On the other hand, from the standpoint of easily obtaining the martensite phase, addition of about 2.0 to 2.5% of Mn is preferable.

P: 0.1% or Less

Phosphorus (P) strengthens the steel and may be contained in an amount necessary for achieving the desired strength. In order to use this strengthening effect, the P content is preferably 0.005% or more. Containing excessive P, however, degrades press workability. Thus, the P content is set to 0.1% or less. If the press workability is an important factor, the P content is preferably 0.04% or less.

S: 0.02% or Less

Sulfur (S) exists as an inclusion in the steel sheet and degrades ductility and workability (in particular, stretch flangeability). The amount of S is preferably as small as possible. Little adverse effects occur when the S content is reduced to 0.02% or less; thus, the S content is regulated to 0.02% or less. When more stringent stretch-flangeability is required, the S content is preferably 0.01% or less. From the standpoint of steel-making cost for desulfurization, the S content is preferably 0.001% or more.

Al: 0.1% or Less

Aluminum (Al) is added as a deoxidation element for steel and is useful for improving cleanliness of the steel. However incorporation of more than 0.1% of aluminum does not further increase the deoxidation effect but only degrades press workability. Thus, the Al content (total Al) is set to 0.1% or less. Preferably, the Al content is 0.01% or more to achieve the effect as the deoxidation element.

N: 0.02% or Less

As with carbon, nitrogen (N) increases the strength of the steel sheet by solid solution hardening and strain aging. At a N content exceeding 0.02%, however, the amount of nitrides in the steel sheet increases, and the ductility and the press workability of the steel are significantly degraded thereby. Thus, the N content is set to 0.02% or less. When the press workability needs to be improved, the N content is preferably 0.01% or less and more preferably 0.005% or less. Nitrogen easily enters from the atmosphere and it is preferable to allow content of at least 0.002% of N from the standpoint of production.

At Least One of Nb, Ti, V, and Mo: a Total of 0.2% or Less

Niobium (Nb), titanium (Ti), and vanadium (V) are all carbide-forming elements and effectively enhance strength by fine dispersion of the carbides. Thus, they may be selected to be included according to need. Moreover, molybdenum (Mo) is one of the strengthening elements and also has an effect of increasing quench hardenability. Thus, molybdenum may be contained if necessary. In the case where these elements are used for strengthening, they are preferably contained in a total amount of 0.005% or more to achieve sufficient effects. If the total exceeds 0.2%, then the problems such as degradation in press workability and chemical convertibility. Moreover, since these elements are carbide-forming elements, they decrease the amount of solute carbon and hamper improvement of ΔTS. Thus, when they are to be contained, the total amount of at least one of Nb, Ti, V, and Mo is adjusted to 0.2% or less and more preferably 0.1% or less.

Among these elements, Nb has favorable effects on the properties of the steel sheet since Nb also has an effect of making the ferritic grains finer.

In addition to the elements described above, at least one of Ca: 0.1% or less and REM: 0.1% or less may be contained as an auxiliary element. They are both elements that contribute to improvements of stretch-flangeability through shape control of the inclusions. However, when they are contained in an amount exceeding 0.1%, respectively, the cleanliness of the steel is degraded and the ductility is decreased.

From the standpoint of formation of martensite, at least one of B: 0.1% or less and Zr: 0.1% or less may be contained.

In addition to the above-described elements and the balance Fe, various impurity elements inevitably enter from the starting materials and production facility during the production process. However, these inevitable impurities do not significantly affect the effects and should be allowed. Examples of the inevitable impurities are Sb: 0.01% or less, Sn: 0.1% or less, Zn: 0.01% or less, and Co: 0.1% or less.

Although Al has been described as the deoxidation element, a steel production method that uses an deoxidation method other than one using Al is not excluded from the scope of the disclosure. For example, Ti deoxidation or Si deoxidation may be conducted, and Ca and/or REM may be added to the molten steel during the deoxidation.

Properties of Steel Sheet

The hot-rolled steel sheet having the microstructure and composition described above has excellent press workability and strain aging property.

As noted above, "excellent strain aging property" means that when the steel sheet has been subjected to heat-treatment in the temperature range of 150° C. to 200° C. for a retention time of 30 second or more after pre-straining at a plastic strain of 2% or more (including 1.5%), e.g., 3%, the increase ΔTS (=(tensile strength after heat treatment)−(tensile strength of steel sheet not subjected to pre-straining and heat treatment)) in tensile strength from before to after the heat treatment is 100 MPa or more. Here, the pre-straining and heat-treatment are collectively referred to as strain aging.

Preferably, ΔTS is 150 MPa or more. More preferably, ΔTS is 200 MPa or more.

As a result of strain aging, the yield stress also increases and the increase ΔYS in yield stress from before to after the strain aging (=(yield stress after strain aging)−(yield stress before strain aging)) becomes 100 MPa or more.

According to a known bake-hardening test method, 170° C. and 20 minutes are employed as the heat treatment conditions. Also, the heat treatment temperature is sufficient if it is in the range of 150° C. to 200° C., and therefore, sufficient effects can be obtained in the existing component-production process.

Note that representing value of ΔTS (and ΔYS) is defined as the average of the observed values under pre-strain: 3% and aging conditions: 150° C., 20 minutes and 200° C., 20 minutes. In general, the most effective range of the conditions is pre-strain: about 1.5% to 3% and aging conditions: 150° C. to 200° C. for 10 to 20 minutes. Within this range, fluctuation of ΔTS is relatively small.

For the steel sheets having strain aging property, room temperature aging (age hardening) is problematic. This is a phenomenon of an increase in strength of a steel sheet stored for a long time at room temperature and is particularly problematic at the time of working it into components. The steel sheet was subjected to tensile test after heat treatment (200° C., 20 minutes) without pre-strain (0%) to investigate the aging property. It was confirmed that no increase in strength (TS and YP) was observed and that the steel sheet also had high aging resistance.

A steel sheet having a ferrite phase grain size of 15 μm or less and satisfying $Hv(\alpha_{SA})/Hv(M_{SA})\geq 0.6$ further has excellent fatigue property after strain aging. That is, the fatigue strength ratio is 0.8 or more.

The steel sheet also maintains excellent workability (ductility) and hole expandability comparable or superior to those of existing steel of the same strength (before strain aging).

Method for Making the Invention Steel Sheet

A method for making the hot-rolled steel sheet will now be described.

The hot-rolled steel sheet having the above-described microstructure can be obtained by using, as a raw material, a steel slab having the composition within the ranges described above, hot-rolling the raw material under predetermined conditions, and coiling the hot-rolled material.

The steel slab used is preferably produced by a continuous casting process to prevent macroscopic segregation of elements but may be produced by an ingot casting process or a thin slab casting process.

According to a standard method, the steel slab produced is cooled to room temperature and then heated again. Alternatively, an energy-saving process of delivering a hot steel slab to a heating furnace without cooling or directly rolling the steel slab after brief thermal insulation can be applied without particular problem.

The temperature of heating the steel slab need not be limited. At less than 900° C., however, the rolling load is increased, and the possibility of troubles during hot rolling is increased. The slab heating temperature is preferably 1300° C. or less to avoid an increase in scale loss resulting from an increase in oxidation weight.

Subsequently, steps such as hot-rolling, cooling, and coiling are performed. These steps are regulated as follows.

Hot-Rolling Finishing Temperature: $Ar_3$ Transformation Point or Higher

A homogeneous hot-rolled steel sheet microstructure can be achieved and a dual-phase structure of martensite and ferrite can be easily obtained by adjusting the finishing temperature (finish-rolling temperature) (FT) to the $Ar_3$ transformation point or higher. If the finishing temperature is less than the $Ar_3$ transformation point, the rolling load during hot rolling is increased and the possibility of troubles during hot rolling is increased. Furthermore, since ferrite is generated during rolling and the ferrite fraction exceeds our range, the effect of significantly increasing the strength desirable cannot be achieved.

Cooling Condition: After Finish Rolling, Steel is Cooled to a Martensitic Transformation Temperature (Ms Point) or Less at a Cooling Rate of 20° C./sec or More After finish rolling, the steel is cooled to the Ms point or lower to transform untransformed austenite to martensite. If the steel is not cooled to the Ms point or less, the untransformed austenite is transformed into pearlite or bainite, and the martensite cannot be obtained. Thus, the cooling stop temperature after finish rolling is set to the Ms point or less. Moreover, the fractions of the martensite, ferrite, and the like and the ferritic grain size change depending on the cooling rate, and a cooling rate of less than 20° C./sec does not give desired fractions or ferritic grain size. Thus, the cooling rate is set to 20° C./sec or more. Here, the cooling rate means the average cooling rate, i.e., (steel sheet temperature at the start of cooling—steel sheet temperature at the end of cooling)/time required for cooling.

From the standpoint of ensuring the amount of solute carbon, the cooling rate is more preferably 50° C./sec or more and most preferably 100° C./sec or more. When a steel having our composition is produced under the cooling conditions described above, a desirable structure with a desirable ferrite fraction and grain size can be obtained.

To improve the fatigue property in addition to the strain aging property, the steel is cooled to the martensitic transformation temperature (Ms point) or less at a rate of 40° C./sec or more after finish rolling. In order to improve the fatigue property, it is effective to decrease the difference in hardness between the martensite and the ferrite after strain aging. It is possible to decrease the difference in hardness by decreasing the grain size of the ferrite and the fraction of the ferrite. The grain size and fraction of the ferrite change according to the cooling rate. At a cooling rate of less than 40° C./sec, the difference in hardness after strain aging is large, and the fatigue property is inferior. Thus, in order for the ferrite grain size and fraction to fall within the ranges that exhibit excellent fatigue property, the cooling rate is set to 40° C./sec or more. In order to stably achieve excellent fatigue property, the cooling rate is preferably 50° C./sec or more and, in order to achieve higher fatigue property, the cooling rate is more preferably 100° C./sec or more.

The upper limit of the cooling rate is not particularly limited as long as the cooling rate is within the range anticipated from the performance of the existing facility.

In order to reduce the third phase, such as bainite, a cooling pattern that has little or no overlap with the region in which the third phase appears in a CCT diagram may be selected. The grain size of the third phase is affected by the cooling rate as with the ferrite phase. The grain size of the martensite phase can be controlled by a known method, e.g., by administering the FT and the reduction ratio immediately before completion of the finish rolling.

Examples of the techniques for preventing an excessive increase in amount of solute carbon in the ferrite phase include increasing the cooling rate in the temperature range of from a temperature 100° C. less than the $Ar_3$ transformation point to the $Ar_3$ transformation point, the range being immediately after formation of the ferrite, for example, increasing the cooling rate to 70° C./s or more.

The time from completion of the finish rolling and to the start of cooling is not particularly limited. However, the time may be determined to any length according to needs. In other words, because a ferrite phase appears during the time the steel sheet is stood to cool before the start of forced cooling, by a decrease in steel sheet temperature and a steel sheet microstructure approaching to an equilibrium state, the ferrite fraction can be controlled by adjusting this length of time.

In order to render the steel sheet soft (low tensile strength) by increasing the ferrite fraction, it is effective not to start (forced) cooling immediately after finish rolling but to start cooling after a time period of 1 second or more. However, if the time is excessively long, the steel sheet temperature decreases to a temperature range of a ferrite single phase and martensite cannot be obtained. Thus, it is preferable to start cooling before this happens. Moreover, in order to enhance the fatigue property, it is preferable to start cooling within 3 seconds from completion of finish rolling to ensure refinement of ferritic grain size and a decrease in ferrite fraction. However, if the time up to start of cooling is excessively short, the ferrite fraction and the grain size become out of our range, thereby substantially creating a martensitic single-phase structure. Thus, it is preferable to start cooling after more than 0.3 seconds from completion of hot rolling.

Coiling Temperature: 300° C. or Less

The coiling temperature CT is important for obtaining the microstructure. At a coiling temperature exceeding 300° C., untransformed austenite transforms to pearlite or bainite and martensite is not formed. Thus, the structure including martensite as the dominant phase, which is required, cannot be formed. A more preferable range of the coiling temperature is 200° C. or less from the standpoint of suppressing formation of carbides and ensuring the amount of solute carbon. On the other hand, if a relatively high CT is employed, e.g., 150° C. to 300° C., in particular, about 200° C. or more from the standpoint of equipment performance and operating efficiency, about 2.0 to 2.5% of Mn is preferably added.

No Tempering at 350° C. or More

Martensitic steel and the like are usually subjected to tempering at a high temperature of 350° C. or more to improve toughness. However, by conducting tempering, carbides are formed and the amount of solute carbon decreases to less than 0.01%. Since the solute carbon has an important function, such heating treatment must not be conducted.

"Tempering" means heat-treatment at high temperature or for a long period of time intentionally conducted as described above. The term does not include self-tempering during cooling inevitable for production. Heat-treatment at low temperature for a short period of time (less than 350° C. for 180 minutes or less, preferably 300° C. or less and more preferably 250° C. or less, preferably for 60 minutes or less), which is generally called "tempering", does not impair the strain aging property and is not included in the "tempering." Thus, such heat treatment can be conducted according to need.

In other words, the requirement above can be reworded as "either no tempering is conducted or tempering at less than 350° C. is conducted."

The hot-rolled steel sheet may be subjected to surface treatment such as surface coating. In this regard, surface treatment such as electroplating that does not accompany high-temperature heat treatment is possible. The hot-rolled steel sheet may be subjected to special treatment after plating to improve chemical convertibility, weldability, press workability, and corrosion resistance.

Usage of Steel Sheet and Preferable Conditions

The steel sheet is preferably used in a usage where strain-aging effect is achieved by heat treatment after forming or working such as press working.

The strain during forming or working is most preferably 1.5% to 3% equivalent to a preferable pre-strain from the standpoint of ΔTS, and use within this range is preferable. However, the steel sheet can be used at a strain of 0.5% or more as long as it is in the region of uniform elongation.

From the standpoint of ΔTS, similarly, the preferable aging temperature is in the range of 150° C. to 200° C. Still, the steel sheet can be used for the aging temperature in the range of 100° C. to 300° C., preferably 250° C. or less. The favorable range of the aging time differs depending on the temperature (e.g., when the aging temperature is 150° C. to 200° C. as described above, the time is preferably 10 to 20 minutes). If the aging time becomes below or beyond the range, ΔTS will decrease. Still, in general, employable aging time can be 30 seconds to 6 hours and preferably 10 to 40 minutes.

A preferable type of working is one that accompanies strain in a wide region, such as press working and bending.

The proportions of individual phases in the steel microstructure and the grain shape of a product that has been worked and heat-treated (i.e., product subjected to strain aging) do not substantially change. However, the structure, in particular, the ferrite phase, is hardened. The worked product can achieve a strength (equivalent to TS) of about 550 MPa or more and more preferably about 700 MPa or more.

When the steel sheet in which the ferritic grain size is controlled to 15 μm is worked and heat-treated under proper conditions such that the worked product satisfy equation (1) below, the product exhibits excellent fatigue property (fatigue strength ratio≥0.8):

$$Hv(\alpha)/Hv(M) \geq 0.6 \quad (1)'$$

(wherein Hv(α): hardness of ferrite phase, Hv(M): hardness of martensite phase).

EXAMPLES

Example 1

Example 1 in which the strain aging property was investigated will now be described.

Each molten steel having a composition shown in Table 1 (balance being Fe and impurities) was made and formed into a steel slab, and the steel slab was heated to 1250° C. and hot-rolled under the conditions shown in Table 2 to form a hot-rolled steel strip (hot-rolled sheet) having a thickness of 3.0 mm. The stopping temperature of the rapid cooling was the same as CT except for Sample J. The hot-rolled steel strip (hot-rolled sheet) was analyzed to determine microstructure, amount of solute carbon, tensile properties, and strain aging property according to the following methods.

(1) Microstructure

A specimen was taken from the resulting steel strip, and the microstructure of a cross section (L cross section) taken in a direction parallel to the rolling direction was photographed using an optical microscope or a scanning electron microscope. The fraction of the ferrite structure, which was the second phase, was determined using an image analyzer. There was substantially zero third phase (bainite, pearlite, retained austenite, or the like). The ferritic grain size was determined as an average grain size based on the area of the ferrite phase determined by image analysis and the number of grains by circle approximation.

(2) Amount of Solute Carbon

After a specimen for analytical use was taken from the hot-rolled steel sheet, the amount of carbon (total amount of carbon) and the amount of precipitated carbon (carbon existing as a form of precipitate) in the steel were determined by a wet method, and the difference between the amount of carbon and the amount of precipitated carbon in the steel was assumed to be the amount of solute carbon. Alternatively, the amount of precipitated carbon may be determined from the size and density of the carbides by observation of a specimen for microstructural observation.

(3) Tensile Properties

A test piece for tensile test defined as an A370-03A sub size specimen by ASTEM was taken along a rolling direction from the resulting steel strip, and tensile test was conducted according to the prescriptions of JIS Z 2241 to determine yield stress YS, tensile strength TS, elongation (total elongation) T. EL, and local elongation L. EL. For the purpose of confirmation, yield elongation YPEL was also determined.

(4) Strain Aging Property

An ASTEM A370-03A test piece for tensile test was taken along a rolling direction from the resulting steel strip (hot-rolled steel sheet), and plastic deformation of 3% was applied as the pre-deformation (tensile pre-strain). Heat treatment at 150° C. and 200° C. was then performed for 20 minutes, and the tensile test was conducted to determine the tensile strength TS' (average of TS' of the steel heat-treated at 150° C. and TS' of the steel heat-treated at 200° C.) after heat treatment and to thereby calculate ΔTS=TS'−TS. TS represents the tensile strength of the steel strip (hot-rolled steel sheet).

The results are shown in Tables 2 and 3.

TABLE 1

| Steel | Chemical components (mass %) | | | | | | | | | | | $Ar_3$ | Ms |
|---|---|---|---|---|---|---|---|---|---|---|---|---|---|
| No. | C | Si | Mn | P | S | Al | N | V | Nb | Ti | Mo | (° C.) | (° C.) |
| 1 | 0.050 | 0.01 | 1.5 | 0.012 | 0.006 | 0.045 | 0.0021 | — | 0.015 | — | — | 773 | 475 |
| 2 | 0.047 | 2.50 | 1.5 | 0.013 | 0.006 | 0.044 | 0.0021 | — | 0.037 | — | — | 772 | 475 |
| 3 | 0.118 | 0.01 | 0.8 | 0.015 | 0.005 | 0.045 | 0.0036 | — | 0.034 | — | 0.001 | 744 | 441 |
| 4 | 0.095 | 0.02 | 1.5 | 0.013 | 0.005 | 0.037 | 0.0032 | 0.04 | — | — | — | 759 | 457 |
| 5 | 0.247 | 0.01 | 1.5 | 0.013 | 0.006 | 0.044 | 0.0021 | — | 0.005 | — | — | 710 | 403 |
| 6 | 0.050 | 0.01 | 1.5 | 0.012 | 0.006 | 0.045 | 0.0021 | — | — | — | — | 773 | 475 |
| 7 | 0.093 | 0.01 | 1.5 | 0.013 | 0.005 | 0.037 | 0.0280 | — | 0.05 | — | — | 759 | 459 |
| 8 | 0.093 | 0.01 | 1.5 | 0.013 | 0.005 | 0.037 | 0.0029 | — | 0.035 | — | — | 759 | 459 |
| 9 | 0.141 | 0.01 | 1.5 | 0.013 | 0.005 | 0.046 | 0.0037 | — | — | 0.20 | — | 744 | 442 |
| 10 | 0.141 | 0.01 | 1.5 | 0.013 | 0.005 | 0.046 | 0.0037 | — | — | 0.54 | — | 744 | 442 |
| 11 | 0.100 | 0.01 | 1.5 | 0.012 | 0.006 | 0.045 | 0.0021 | — | 0.08 | 0.015 | — | 757 | 457 |
| 12 | 0.017 | 1.80 | 2.8 | 0.021 | 0.005 | 0.004 | 0.0032 | — | — | — | — | 687 | 439 |
| 13 | 0.140 | 0.05 | 3.6 | 0.021 | 0.005 | 0.004 | 0.0032 | — | — | — | — | 577 | 359 |
| 14 | 0.100 | 0.01 | 2.0 | 0.013 | 0.006 | 0.044 | 0.0021 | — | 0.005 | — | — | 717 | 437 |
| 15 | 0.150 | 0.01 | 2.0 | 0.013 | 0.006 | 0.044 | 0.0021 | — | 0.005 | — | — | 702 | 419 |
| 16 | 0.015 | 0.01 | 1.5 | 0.013 | 0.006 | 0.044 | 0.0021 | — | 0.005 | — | — | 785 | 489 |
| 17 | 0.012 | 0.01 | 1.7 | 0.013 | 0.006 | 0.044 | 0.0021 | — | 0.005 | — | — | 769 | 481 |
| 18 | 0.020 | 0.01 | 0.8 | 0.013 | 0.006 | 0.044 | 0.0021 | — | 0.005 | — | — | 838 | 513 |
| 19 | 0.080 | 0.01 | 2.3 | 0.013 | 0.006 | 0.038 | 0.0024 | — | — | — | — | 700 | 433 |
| 20 | 0.080 | 0.01 | 2.3 | 0.013 | 0.006 | 0.038 | 0.0024 | — | 0.005 | — | — | 700 | 433 |
| 21 | 0.008 | 0.01 | 1.3 | 0.013 | 0.006 | 0.038 | 0.0024 | — | 0.005 | — | — | 780 | 472 |

* "—" in component columns indicates that no corresponding element was added.

TABLE 2

| Sample ID | Steel No. | FT (° C.) | FT-$Ar_3$ (° C.) | Cooling rate (° C./sec) | CT (° C.) | Ferrite Fraction (%) | Ferrite Grain size (μm) | Amount of solute carbon (mass %) |
|---|---|---|---|---|---|---|---|---|
| A | 1 | 898 | 125 | 246 | 89 | 5 | 3.4 | 0.032 |
| B | 1 | 803 | 30 | 18 | 176 | 76 | 24.0 | 0.001 |
| C | 2 | 753 | −19 | 59 | 251 | 54 | 18.0 | 0.001 |
| D | 3 | 905 | 161 | 47 | 182 | 2 | 1.8 | 0.123 |
| E | 4 | 900 | 141 | 53 | 164 | 7 | 3.2 | 0.073 |
| F | 4 | 748 | −11 | 67 | 78 | 67 | 7.8 | 0.007 |
| G | 5 | 911 | 201 | 68 | 96 | 0 | — | 0.001 |
| H | 6 | 896 | 123 | 126 | 297 | 1 | 2.3 | 0.012 |
| I | 7 | 902 | 143 | 124 | 128 | 0 | — | 0.006 |
| J | 8 | 786 | 27 | 117 | 497* | 3 | 2.8 | 0.001 |
| K | 9 | 763 | 19 | 26 | 232 | 8 | 2.8 | 0.122 |
| L | 9 | 799 | 55 | 21 | 31 | 27 | 2.6 | 0.016 |
| M | 10 | 800 | 56 | 23 | 189 | 3 | 1.8 | 0.003 |
| N | 11 | 873 | 116 | 79 | 204 | 5 | 3.1 | 0.076 |
| O | 12 | 784 | 97 | 43 | 176 | 4 | 20.0 | 0.011 |
| P | 13 | 764 | 187 | 29 | 207 | 0 | — | 0.001 |
| Q | 14 | 850 | 133 | 15 | 50 | 29 | 30.1 | 0.027 |
| R | 15 | 850 | 148 | 17 | 50 | 25 | 32.1 | 0.041 |
| S | 16 | 850 | 65 | 35 | 200 | 26 | 18.9 | 0.013 |
| T | 17 | 850 | 81 | 35 | 200 | 24 | 19.2 | 0.010 |
| U | 18 | 848 | 10 | 55 | 250 | 21 | 11.1 | 0.015 |
| V | 19 | 800 | 100 | 15 | 250 | 33 | 31 | 0.002 |
| w | 20 | 725 | 25 | 55 | 250 | 9 | 12 | 0.020 |
| X | 20 | 725 | 25 | 55 | 480 | 7.6** | 12.2 | 0.001 |
| Y | 21 | 805 | 25 | 55 | 250 | 16 | 13 | 0.014 |

*Cooling stopping temperature: 27° C.
**Dominant phase was bainite.

TABLE 3

| Sample ID | Steel No. | YP (MPa) | YPEL (%) | TS (MPa) | T. EL (%) | L. EL (%) | TS' (MPa) | ΔTS (MPa) | Remarks |
|---|---|---|---|---|---|---|---|---|---|
| A | 1 | 573 | 0 | 703 | 21.8 | 17.2 | 1042 | 339 | Example |
| B | 1 | 564 | 0 | 679 | 16.8 | 10.1 | 686 | 7 | C. Ex. |
| C | 2 | 638 | 0 | 786 | 18.6 | 9.8 | 752 | −34 | C. Ex. |
| D | 3 | 1071 | 0 | 1227 | 16.2 | 11.2 | 1342 | 115 | Example |
| E | 4 | 670 | 0 | 861 | 20.0 | 15.2 | 1214 | 353 | Example |
| F | 4 | 848 | 0 | 1024 | 8.9 | 3.9 | 1258 | 23 | C. Ex. |

TABLE 3-continued

| Sample ID | Steel No. | YP (MPa) | YPEL (%) | TS (MPa) | T. EL (%) | L. EL (%) | TS' (MPa) | ΔTS (MPa) | Remarks |
|---|---|---|---|---|---|---|---|---|---|
| G | 5 | 1346 | 0 | 1812 | 7.5 | 4.3 | 1560 | −252 | C. Ex. |
| H | 6 | 598 | 0 | 707 | 15.7 | 10.7 | 832 | 125 | Example |
| I | 7 | 1156 | 0 | 1369 | 7.3 | 2.3 | 1366 | −2 | C. Ex. |
| J | 8 | 854 | 0 | 1038 | 13.3 | 8.1 | 981 | −57 | C. Ex. |
| K | 9 | 949 | 0 | 1187 | 15.0 | 12.4 | 1444 | 256 | Example |
| L | 9 | 870 | 0 | 978 | 21.4 | 16.4 | 1136 | 158 | Example |
| M | 10 | 1094 | 0 | 1368 | 11.7 | 6.6 | 1431 | 63 | C. Ex. |
| N | 11 | 694 | 0 | 951 | 13.5 | 10.2 | 1208 | 257 | Example |
| O | 12 | 517 | 0 | 673 | 22.9 | 17.9 | 782 | 109 | Example |
| P | 13 | 1180 | 0 | 1405 | 21.4 | 10.5 | 1387 | −18 | C. Ex. |
| Q | 14 | 795 | 0 | 935 | 15.6 | 11.2 | 952 | 17 | C. Ex. |
| R | 15 | 1021 | 0 | 1201 | 11.4 | 10.1 | 1214 | 13 | C. Ex. |
| S | 16 | 415 | 0 | 488 | 28.7 | 15.4 | 592 | 105 | Example |
| T | 17 | 421 | 0 | 496 | 26.4 | 13.4 | 603 | 107 | Example |
| U | 18 | 473 | 0 | 556 | 23.6 | 16.4 | 670 | 114 | Example |
| V | 19 | 700 | 0 | 824 | 20.9 | 16.2 | 835 | 11 | C. Ex. |
| W | 20 | 764 | 0 | 899 | 18.9 | 14.6 | 1055 | 156 | Example |
| X | 20 | 865 | 0 | 1072 | 18.7 | 14.3 | 1075 | 3 | C. Ex. |
| Y | 21 | 437 | 0 | 878 | 19.3 | 14.7 | 989 | 111 | Example |

C. Ex: Comparative Example

As shown in Tables 2 and 3, notably high ΔTS was observed for Samples (ID) A, D, E, H, K, L, N, O, S to U, and Y, which are our examples, and it was confirmed that these steel sheets had excellent strain aging property. In contrast, Samples G, I, and P, which were outside our component range, had a martensitic single-phase structure, and thus these steel sheets had small ΔTS. Sample C containing excessive Si had a high ferrite fraction and small ΔTS. Sample M containing excessive Ti also had small ΔTS because the amount of solute carbon was less than 0.01 percent by mass.

Sample F having the composition in our range had a ferrite fraction outside our range and ferrite was dominant phase since the hot-rolling finishing temperature was low and was in the temperature range that generates ferrite. As for Sample J with a coiling temperature outside our range, although the ferrite fraction was satisfied, the amount of solute carbon was outside our range, and ΔTS was low. When the cooling rate was low, the ferrite fraction was high in Sample B and the grain size was outside the range in Samples Q and R although they satisfied the ferrite fraction. Moreover, Sample V had the fraction and grain size both outside our ranges. In each case, resultant ΔTS was small. Sample X having a (rapid-)cooling stopping temperature higher than the Ms point had a bainite dominant phase since martensite transformation did not occur, and exhibited small ΔTS.

As is described above, Comparative Examples outside our range all provide steel sheets with small ΔTS.

With respect to the workability of our steel, the total elongation (T. EL) is about the same as that of the martensitic steel sheet. The local elongation (L. EL) which is an indicator of the hole expandability is 10% or more in all samples. This value is comparable to or higher than that of existing materials having the same strength. Thus, it can be understood that the hole expandability is comparable to or superior to that of the existing materials.

The comparison between Sample W and Sample Y shows that it is easy to increase the strength by formation of martensite when Mn is contained in an amount of 2.0% or more despite a CT of 250° C.

Example 2

Example 2 will now be described. In this example, not only the strain aging property but also fatigue property is focused.

Each molten steel having a composition shown in Table 4 (balance being Fe and impurities) was made and formed into a steel slab, and the steel slab was heated to 1200° C. and hot-rolled under the conditions shown in Table 5 to form a hot-rolled steel strip (hot-rolled sheet) having a thickness of 3.0 mm. The resulting hot-rolled steel strip (hot-rolled sheet) was analyzed to determine the microstructure, the amount of solute carbon, the tensile properties, the strain aging property, the hardness of the dominant phase and the ferrite phase after strain aging, and the fatigue property. (1) Microstructure, (2) amount of solute carbon, (3) tensile properties, and (4) strain aging property were determined as in Example 1. Hardness and fatigue property were determined as follows.

(5) Hardness

A JIS No. 5 test piece for tensile test was taken in a rolling direction from the resulting steel strip (hot-rolled sheet), and 1.5% of plastic deformation was applied as pre-deformation (tensile pre-strain), followed by heat treatment at 200° C.×20 min. Subsequently, the martensite phase and the ferrite phase were identified in an L cross section, and the hardness Hv(M) of the martensite phase and hardness Hv(α) of the ferrite phase were determined by micro Vickers hardness measurement under a load of 500 g. The hardness of each phase was determined as an average of 5 positions.

The hardness ratio Hv(α)/Hv(M) was calculated from the observed hardness.

(6) Fatigue Property

JIS No. 5 tensile test pieces were taken in a rolling direction from the resulting steel strip (hot-rolled sheet), and 1.5% of plastic deformation was applied as the pre-deformation (tensile pre-strain), followed by heat treatment at 200° C.×20 min. Subsequently, tensile fatigue test was conducted to determine fatigue limit FL'after strain aging and to calculate the fatigue strength ratio FL'/TS (TS is the tensile strength of the steel strip). The fatigue limit was assumed to be the tensile stress at the limit at which the steel did not break by 106 times of repeated tension.

The results are shown in Tables 5 and 6.

TABLE 4

| Steel | Chemical components (mass %) | | | | | | | | | | | $Ar_3$ | Ms |
|---|---|---|---|---|---|---|---|---|---|---|---|---|---|
| No. | C | Si | Mn | P | S | Al | N | V | Nb | Ti | Mo | (° C.) | (° C.) |
| 31 | 0.05 | 0.01 | 1.6 | 0.012 | 0.006 | 0.045 | 0.0021 | — | 0.015 | — | — | 773 | 475 |
| 32 | 0.12 | 0.01 | 0.74 | 0.087 | 0.005 | 0.045 | 0.0036 | — | 0.034 | — | 0.001 | 744 | 441 |
| 33 | 0.095 | 0.02 | 1.6 | 0.013 | 0.005 | 0.037 | 0.0032 | 0.04 | — | — | — | 759 | 457 |
| 34 | 0.05 | 0.01 | 1.6 | 0.012 | 0.006 | 0.045 | 0.0021 | — | — | — | — | 773 | 475 |
| 35 | 0.090 | 0.01 | 1.5 | 0.013 | 0.005 | 0.037 | 0.0028 | — | 0.04 | — | — | 759 | 459 |
| 36 | 0.14 | 0.01 | 1.5 | 0.013 | 0.005 | 0.040 | 0.0037 | — | — | 0.45 | — | 744 | 442 |
| 37 | 0.10 | 0.01 | 1.5 | 0.012 | 0.006 | 0.035 | 0.0021 | — | 0.08 | 0.015 | — | 757 | 457 |
| 38 | 0.016 | 1.8 | 2.8 | 0.021 | 0.005 | 0.004 | 0.0032 | — | — | | — | 687 | 439 |
| 39 | 0.14 | 0.05 | 3.5 | 0.021 | 0.005 | 0.004 | 0.0032 | — | — | | — | 577 | 359 |
| 40 | 0.06 | 0.01 | 2.4 | 0.012 | 0.006 | 0.004 | 0.0025 | — | — | — | — | 698 | 436 |
| 41 | 0.06 | 0.01 | 2.2 | 0.012 | 0.006 | 0.004 | 0.0025 | — | 0.015 | — | — | 714 | 444 |

"—" in component columns indicate that no corresponding element was added.

TABLE 5

| Sample ID | Steel No. | FT (° C.) | FT-$Ar_3$ (° C.) | Cooling rate (° C./sec) | CT (° C.) | Ferrite Fraction (%) | Ferrite Grain size (μm) | Amount of solute carbon (mass %) | Hv(α)/Hv(M) after strain aging |
|---|---|---|---|---|---|---|---|---|---|
| A | 31 | 890 | 117 | 246 | 100 | 5.1 | 3.4 | 0.032 | 0.88 |
| B | 31 | 800 | 27 | 18 | 170 | 76 | 24 | 0.001 | 0.42 |
| C | 32 | 890 | 146 | 126 | 300 | 1.4 | 2.3 | 0.012 | 0.76 |
| D | 33 | 900 | 141 | 47 | 20 | 2.0 | 1.8 | 0.012 | 0.78 |
| E | 33 | 800 | 41 | 45 | 420 | 2.7 | 1.8 | 0.003 | 0.45 |
| F | 34 | 890 | 117 | 53 | 20 | 6.7 | 3.2 | 0.073 | 0.88 |
| G | 35 | 770 | 11 | 67 | 80 | 8.7 | 7.8 | 0.032 | 0.90 |
| H | 36 | 900 | 156 | 124 | 130 | 0 | — | 0.006 | — |
| I | 37 | 870 | 113 | 79 | 200 | 4.6 | 3.1 | 0.076 | 0.81 |
| J | 38 | 780 | 93 | 43 | 170 | 4.0 | 13.5 | 0.011 | 0.75 |
| K | 39 | 760 | 183 | 29 | 200 | 0 | — | 0.001 | — |
| M | 40 | 725 | 27 | 60 | 210 | 7.8 | 10.5 | 0.017 | 0.77 |
| N | 41 | 760 | 46 | 120 | 190 | 4.8 | 3.4 | 0.017 | 0.88 |

TABLE 6

| Sample ID | Steel No. | YP (MPa) | YPEL (%) | TS (MPa) | T. EL (%) | L. EL (%) | TS' (MPa) | ΔTS (MPa) | FL'/TS | Remarks |
|---|---|---|---|---|---|---|---|---|---|---|
| A | 31 | 570 | 0 | 700 | 21.8 | 17.2 | 1040 | 340 | 0.92 | Example |
| B | 31 | 415 | 0 | 560 | 16.8 | 10.1 | 570 | 10 | 0.70 | C. Ex. |
| C | 32 | 590 | 0 | 700 | 15.7 | 10.7 | 820 | 120 | 0.92 | Example |
| D | 33 | 1070 | 0 | 1220 | 16.2 | 11.2 | 1340 | 120 | 0.88 | Example |
| E | 33 | 1090 | 0 | 1368 | 11.7 | 6.6 | 1430 | 62 | 0.69 | C. Ex. |
| F | 34 | 670 | 0 | 860 | 20.0 | 15.2 | 1210 | 350 | 0.92 | Example |
| G | 35 | 845 | 0 | 1024 | 8.9 | 3.9 | 1250 | 226 | 0.91 | Example |
| H | 36 | 1150 | 0 | 1365 | 7.3 | 2.3 | 1360 | −5 | 0.88 | C. Ex. |
| I | 37 | 690 | 0 | 950 | 13.5 | 10.2 | 1200 | 250 | 0.93 | Example |
| J | 38 | 520 | 0 | 670 | 22.9 | 17.9 | 780 | 110 | 0.93 | Example |
| K | 39 | 1180 | 0 | 1400 | 21.4 | 16.4 | 1380 | −20 | 0.88 | C. Ex. |
| M | 40 | 680 | 0 | 800 | 21.0 | 12.8 | 953 | 153 | 0.89 | Example |
| N | 41 | 690 | 0 | 812 | 20.8 | 13.1 | 994 | 182 | 0.91 | Example |

C. Ex.: Comparative Example

As shown in Tables 5 and 6, Samples a, c, d, f, g, i, j, m, and n which are our examples all showed notably high ΔTS, and it was confirmed that they provide steel sheets having excellent strain aging property.

In contrast, Sample h having a Ti content outside our component range has a martensite single-phase structure, and thus ΔTS of the steel sheet is low. Moreover, Sample k in which Mn content is outside our component range is a steel sheet having small ΔTS since the martensite single-phase structure is formed despite a low cooling rate after hot rolling.

Even when the composition is within our range, Sample b in which the cooling rate after hot-roll finishing is small has a ferrite fraction outside the range and the ferrite becomes the dominant phase, and Sample e in which the coiling temperature is outside the range has a ferrite fraction within the range but the amount of solute carbon is outside the range. Thus, both samples have small ΔTS. As is described above, Comparative Examples outside our range all provide steel sheet with small ΔTS.

As shown in Tables 5 and 6 with regard to the fatigue property after the strain aging, Samples a, c, d, f, g, i, j, m, and n all exhibited FL'/TS as high as 0.8 or more, and it was confirmed that they provided steel sheets having excellent fatigue property. In contrast, Sample b having the ferrite fraction and grain size outside our range has Hv(α)/Hv(M) ≤0.5, and the fatigue strength ratio FL'/TS is 0.8 or less. This shows that the fatigue property of the sample is lower than that of our examples.

Sample e has a ferrite fraction and grain size within our ranges, but the amount of solute carbon is outside our range. Since Hv(α)/Hv(M)≤0.5, the fatigue strength ratio FL'/TS is 0.8 or less. This shows that the fatigue property of the sample is lower than that of our examples.

Samples h and k having a martensite single-phase structure has satisfactory fatigue property but they provide steel sheets with low strain aging property (ΔTS) as described above.

As is described above, it was confirmed that Samples a, c, d, f, g, i, j, m, and n all exhibited notably large ΔTS and FL'/TS and that steel sheets had excellent strain aging property and fatigue property.

Example 3

A molten steel having a composition including C: 0.1%, Si: 0.01%, Mn: 2.2%, P: 0.012%, S: 0.005%, Al: 0.045%, N: 0.003%, and the balance being Fe and impurities was made and formed into a steel slab, and the steel slab was heated to 1250° C. and hot-rolled under the conditions shown in Table 7 to form a hot-rolled steel strip (hot-rolled sheet) having a thickness of 2.0 mm. The $Ar_3$ transformation point of this steel is 701° C. Ft was 800° C. (i.e., $Ar_3$ transformation point+ about 100° C.), and the rapid-cooling stopping temperature and CT were 180° C. (Ms point: 429° C.).

Sample 3H was subjected to low-temperature tempering under the condition shown in Table 7 after the coiling. In Sample 3I, a small amount of bainite was generated by intentionally slow-cooling the steel for a short time in the bainite nose region (about 500° C.).

The results are shown in Table 8.

TABLE 7

| Sample ID | Time from end of hot-rolling to start of quenching (sec) | Cooling rate (° C./sec) | Ferrite Fraction (%) | Ferrite Grain size (μm) | Amount of solute carbon (mass %) | Hv(α)/Hv(M) after strain aging | Remarks |
|---|---|---|---|---|---|---|---|
| 3A | 0.5 | 150 | 1.9 | 2.1 | 0.029 | 0.79 | |
| 3B | 1.0 | 150 | 3.8 | 3.0 | 0.021 | 0.77 | |
| 3C | 5.0 | 150 | 18.9 | 10.0 | 0.012 | 0.75 | |
| 3D | 2.0 | 20 | 19.3 | 14.7 | 0.012 | 0.78 | |
| 3E | 2.0 | 100 | 10..2 | 5.0 | 0.019 | 0.79 | |
| 3F | 2.0 | 300 | 5.4 | 0.8 | 0.023 | 0.80 | |
| 3G | 0.3 | 300 | 1.1 | 0.8 | 0.03 | 0.82 | |
| 3H | 2.0 | 150 | 7.6 | 2.1 | 0.015 | 0.77 | Tempered at 200° C.-20 minutes |
| 3I | 2.0 | 30 | 16.2 | 18.3 | 0.011 | 0.76 | Bainite fraction was controlled to 5% |

TABLE 8

| Sample ID | YP (MPa) | YPEL (%) | TS (MPa) | T. EL (%) | L. EL (%) | TS' (MPa) | ΔTS (MPa) | FL'/TS |
|---|---|---|---|---|---|---|---|---|
| 3A | 714 | 0 | 842 | 19 | 13.5 | 1250 | 409 | 0.91 |
| 3B | 711 | 0 | 836 | 19.1 | 12.4 | 1206 | 370 | 0.90 |
| 3C | 695 | 0 | 817 | 19.6 | 12.7 | 1105 | 288 | 0.90 |
| 3D | 633 | 0 | 811 | 19.7 | 12.8 | 1070 | 258 | 0.89 |
| 3E | 710 | 0 | 835 | 19.2 | 12.5 | 1175 | 340 | 0.90 |
| 3F | 728 | 0 | 857 | 18.7 | 12.1 | 1272 | 415 | 0.90 |
| 3G | 716 | 0 | 843 | 19 | 12.3 | 1285 | 442 | 0.90 |
| 3H | 720 | 0 | 847 | 18.8 | 12.3 | 1219 | 372 | 0.85 |
| 3I | 665 | 0 | 782 | 20.5 | 13.3 | 935 | 154 | 0.81 |

All samples were within our range and exhibited satisfactory strain aging property and press workability. It can be understood from sample 3H that tempering at low temperature for a short time does not degrade the strain aging property or the fatigue property.

Samples 3A to 3C show that the grain size of the ferrite phase becomes finer as the time until start of the rapid cooling becomes shorter and Samples 3E to 3H show that the grain size of the ferrite phase becomes finer as the cooling rate becomes larger. This tendency is particularly noticeable at a ferrite grain size of 10 μm or less. From the standpoint of load of rapid cooling on the process, the ferrite grain size is preferably 0.5 μm or more.

As comparison between Samples 3F and 3G clearly shows, the dominant phase slightly softens at a small ferrite fraction (about 3% or less). Thus, if the strength of a portion with small strain is desired in the press-worked product, the ferrite fraction is preferably 3% or more. As shown by Samples 3C, 3D, and 3I, there also is a tendency that the steel sheet strength decreases at a high ferrite fraction. Thus, the fraction is preferably 20% or less, in particular, about 15% or less.

Example 4

Sample 3D prepared in Example 3 was press-worked into a piece 50 mm in height, 100 mm in length, and 300 mm in width (the strain at the central portion: equivalent to about 1.5%) having a semicircular cross section, and then subjected to aging at 170° C. for 20 minutes.

A sample was taken from the central portion of the press-worked product, and JIS No. 5 tensile test specimens were taken to determine ΔTS and the fatigue strength ratio. Another sample was taken from the central portion of the press-worked product to determine the ratio Hv(a)/Hv(M).

As a result it was confirmed that ΔTS=258 MPa, Hv(a)/Hv(M)=0.78, and fatigue strength ratio=0.89. It was confirmed that the press-worked product had excellent strength and fatigue strength.

INDUSTRIAL APPLICABILITY

By rendering the microstructure to include a martensite phase as the dominant phase and a predetermined ferrite as the second phase, a hot-rolled steel sheet that has excellent press-workability and excellent strain aging property whereby the tensile strength significantly increases after press working by heat treatment at a temperature about the same as the typical baking temperature can be obtained.

Moreover, stable production of such hot-rolled steel sheets can be made possible.

Furthermore, a hot-rolled steel sheet having excellent strain aging property and, in addition to the above-described properties, excellent fatigue property can be obtained since preferable steel sheets have significantly improved fatigue strength ratio after strain aging.

Thus, our steel sheets are suitable as the material for automobile components and can sufficiently contribute to weight-reduction of the automobile bodies.

The invention claimed is:

1. A hot-rolled steel sheet comprising, in terms of percent by mass,

C: 0.01 to 0.2%, Si: 2.0% or less

Mn: 1.5 to 3.0%, P: 0.1% or less

S: 0.02% or less, Al: 0.1% or less

N: 0.02% or less, the balance being Fe and inevitable impurities, wherein a non-tempered martensite phase is dominant phase, a ferrite phase as a second phase is contained in the range of 3% or more and 20% or less in terms of area ratio, the average grain size of the ferrite phase being 2.8 μm to 20 μm, and an amount of solute carbon is 0.01 percent by mass or more;

wherein the hot-rolled steel sheet has a strain aging property ΔTS of 100 MPa or more, ΔTS being an increase in tensile strength by strain aging corresponding to the difference between a tensile strength of the steel sheet after strain aging and a tensile strength of the steel sheet before strain aging; and wherein the hot-rolled steel sheet has a fatigue strength ratio FL'/TS of 0.8 or more, FL'/TS being a ratio of a fatigue limit under pulsating tension FL' to a tensile strength TS of the steel sheet before strain aging.

2. The hot-rolled steel sheet according to claim 1, further comprising at least one of Nb, Ti, V, and Mo in a total amount of 0.2% or less in terms of percent by mass.

3. A hot-rolled steel sheet comprising, in terms of percent by mass,

C: 0.01 to 0.2%, Si: 2.0% or less

Mn: 1.5 to 3.0%, P: 0.1% or less

S: 0.02% or less, Al: 0.1% or less

N: 0.02% or less, the balance being Fe and inevitable impurities, wherein a non-tempered martensite phase is dominant phase, a ferrite phase as a second phase is contained in the range of 3% 20% in terms of area ratio, the average grain size of the ferrite phase being 2.8 to 15 μm, an amount of solute carbon is 0.01 percent by mass or more, and a hardness $HV(M_{SA})$ of the martensite phase and a hardness $Hv(\alpha_{SA})$ of the ferrite phase each after strain aging involving pre-strain: 1.5% and aging: 200° C., 20 minutes satisfy formula (I) below:

$$Hv(\alpha_{SA})/Hv(M_{SA}) \geq 0.6 \quad \text{Formula (1);}$$

wherein the hot-rolled steel sheet has a strain aging property ΔTS of 100 MPa or more, ΔTS being an increase in tensile strength by strain aging corresponding to the difference between a tensile strength of the steel sheet after strain aging and a tensile strength of the steel sheet before strain aging; and wherein the hot-rolled steel sheet has a fatigue strength ratio FL'/TS of 0.8 or more, FL'/TS being a ratio of a fatigue limit under pulsating tension FL' to a tensile strength TS of the steel sheet before strain aging.

4. The hot-rolled steel sheet according to claim 3, further comprising at least one of Nb, Ti, V, and Mo in a total amount of 0.2% or less in terms of percent by mass.

5. A method for making a hot-rolled steel sheet, comprising the steps of:

hot-rolling a steel slab containing, in terms of percent by mass,

C: 0.01 to 0.2%, Si: 2.0% or less

Mn: 1.5 to 3.0%, P: 0.1% or less

S: 0.02% or less, Al: 0.1% or less

N: 0.02% or less, and the balance being Fe and inevitable impurities;

finish rolling the resulting material with a finishing temperature of the $Ar_3$ point or higher;

within more than 0.3 seconds to 3 seconds after the finish rolling, from completion of finish rolling, cooling the material to a martensite transformation temperature (Ms point) or less at a cooling rate of 20° C./sec or more;

coiling the material at a temperature of 300° C. or less and maintaining an amount of solute carbon of 0.01 percent by mass or more;

performing no tempering or, if tempering is performed, subjecting the resulting material to tempering at a temperature less than 350° C.;

maintaining a strain aging property ΔTS of the hot-rolled steel sheet to be 100 MPa or more, ΔTS being an increase in tensile strength by strain aging corresponding to the difference between a tensile strength of the steel sheet after strain aging and a tensile strength of the steel sheet before strain aging; and maintaininq a fatigue strength ratio FL'/TS of the hot-rolled steel sheet to be 0.8 or more, FL'/TS being a ratio of a fatigue limit under pulsating tension FL' to a tensile strength TS of the steel sheet before strain aging.

6. The method for making the hot-rolled steel sheet according to claim 5, wherein the steel slab further contains at least one of Nb, Ti, V, and Mo in a total amount of 0.2% or less in terms of percent by mass.

7. A worked body of hot-rolled steel sheet produced by subjecting a hot-rolled steel sheet to press working and strain aging, the body containing:

C: 0.01 to 0.2%, Si: 2.0% or less

Mn: 1.5 to 3.0%, P: 0.1% or less

S: 0.02% or less, Al: 0.1% or less

N: 0.02% or less, and the balance being Fe and inevitable impurities;

wherein a non-tempered martensite phase is dominant phase, a ferrite phase as a second phase is contained in the range of 3% to 20% in terms of area ratio, the average grain size of the ferrite phase being 2.8 μm to 15 μm and a hardness Hv(M) of the martensite phase and a hardness Hv(α) of the ferrite phase satisfy formula (1)' below:

$$Hv(\alpha)/Hv(M) \geq 0.6 \quad \text{Formula (1)';}$$

wherein the hot-rolled steel sheet has a strain aging property ΔTS of 100 MPa or more, ΔTS being an increase in tensile strength by strain aging corresponding to the difference between a tensile strength of the steel sheet after strain aging and a tensile strength of the steel sheet before strain aging; and wherein the hot-rolled steel sheet has a fatigue strength ratio FL'/TS of 0.8 or more, FL'/TS being a ratio of a fatigue limit under pulsating tension FL' to a tensile strength TS of the steel sheet before strain aging.

8. The worked body of hot-rolled steel sheet according to claim 7, further comprising at least one of Nb, Ti, V, and Mo in a total amount of 0.2% or less in terms of percent by mass.

* * * * *